United States Patent [19]

Dent

[11] 4,350,192

[45] Sep. 21, 1982

[54] WOOD SPLITTING DEVICE

[76] Inventor: Thomas Dent, R.R. #3, Oak Grove, Mo. 64075

[21] Appl. No.: 209,734

[22] Filed: Nov. 24, 1980

[51] Int. Cl.[3] ..... B27L 7/00

[52] U.S. Cl. ..... 144/193 C

[58] Field of Search ..... 144/193 R, 193 C, 193 D; 254/104; 173/90, 91

[56] References Cited

U.S. PATENT DOCUMENTS 3,050,095 8/1962 Prather ..... 144/193 C 4,254,808 3/1981 Nokes ..... 144/193 C 4,280,540 7/1981 Meacham ..... 144/193 C

*Primary Examiner*—W. D. Bray

*Attorney, Agent, or Firm*—Thomas M. Scofield

[57] ABSTRACT

Improvements in devices used for splitting hardwood fireplace logs; a telescoping, hand operated, one man device utilizing an elongate inner shaft or column carrying wedge splitting means at the lower end, there being provided an outer, fitting sleeve with an end stop and handles for reciprocation on the inner member to provide impacts, blows or thrusts along the longitudinal axis of both; hand portable and hand operable devices for splitting logs utilizing man power.

3 Claims, 6 Drawing Figures

WOOD SPLITTING DEVICE

BACKGROUND OF THE INVENTION

In the days prior to oil and gas heating of houses, the wood stove was an omnipresent fixture in houses, as well as the wood fireplace. Today, with the rise in price of gas and oil heating, the significance of wood heat, both by heating stove and fireplace, again assumes primary importance.

With respect to cutting and splitting wood, the power saw has answered the problem of felling and cutting trees, as well as the branch complexes thereof, into suitable lengths. There remains, however, the problems and work associated with reducing large diameter tree trunks and the like into handleable, carryable and convenient size logs for consumption in stoves and fireplaces. The ancient honored tool in this regard is the simple hand axe, with all its hazards of potential injury to the cutter and hewer of wood. In view of this, a multiplicity of powered or force augmented devices have been developed and are available, to a greater or lesser extent, on the market.

A major problem that arises with respect to log splitters is portability. That is, if all the logs to be split are in one location, then portability is not too important, unless the trunk segments are extremely heavy and difficult to handle. However, this is often not the case and it is very often desirable to be able to not only fell the tree, saw it into sections, but also split the larger diameter sections on the spot. Then the logs may be handled as usable and handleable entities from that point with respect to a central collection spot, if desired.

Basically, log splitting boils down to the application of sufficient force to a wedge-like edge either by muscle power, muscle power plus mass or weight, or hydraulic or gasoline power. What is needed in the present market, it would seem, is a muscle powered device which powerfully and effectively accomplishes the onerous log splitting task, yet has optimum configuration to minimize effort and work on the part of the user, as well as permit convenient and small space storage when not in use. Such a device must, of course, be immensely strong over a long life of use in hard, arduous work. The subject device meets these criteria.

PRIOR ART

I am aware of the following devices for cutting, trimming and splitting wood and analogous devices for like purposes:

Harper U.S. Pat. No. 1,191,176, issued July 18, 1916 for "Tie Cutter";

Green U.S. Pat. No. 2,754,585, issued July 17, 1956 for "Animal Hoof Trimmer";

Polish Pat. No. 48,054, Instytut Badawczy Lesnictwa, issued 1964, available United States Patent Office Scientific Library;

Gue U.S. Pat. No. 3,568,657, issued Mar. 9, 1971 for "Rock-breaking Tool";

Kortendick U.S. Pat. No. 3,982,572, issued Sept. 28, 1976 for "Manual Log Splitter";

Piontkoski, U.S. Pat. No. 4,033,390, issued July 5, 1977 for "Wood Splitter";

Farriss, Jr. 4,061,168, issued Dec. 6, 1977 for "Log Splitting Device"; and

Gansley U.S. Pat. No. 4,157,105, issued June 5, 1979 for "Portable Log Splitter".

BRIEF DESCRIPTION OF THE INVENTION

Briefly stated, the subject device comprises an inner cylindrical shaft (typically a hollow pipe) which is somewhat greater in length than the outer sleeve which comprises the second part of the structure. At the lower end of the inner shaft, there is provided and fixed an integral wedge member. A small handle for carrying the inner shaft, per se (or holding the elements of the device together when the operator switches logs or wishes to move the device in its entirety) is provided above the wedge connection and below the lowest level of extension of the sleeve when it is bottomed on the inner shaft. That is, the outer sleeve does not bottom on the grasping handle on the inner shaft, rather on the upper end of the inner sleeve.

The outer sleeve comprises a cylindrical casing having a closed top. Paired, opposed handles are provided intermediate its length for grasping in use and reciprocation of the outer sleeve on the inner shaft. In operation, the log splitter seats the wedge on the top of the log to be split and then reciprocates the upper sleeve on the inner shaft or pipe, banging down the top of the outer sleeve on the top of the inner shaft to drive the wedge into the log. The paired handles may be moved angularly or rotated on the shaft, once it is embedded in a log to aid freeing the wedge or improve the operator's working position.

OBJECTS OF THE INVENTION

A first object of the invention is to provide an improved muscle powered log splitting device having but two operating parts.

Another object of the invention is to provide an effective, powerful, long lived, rugged log splitting device which is additionally quite portable so as to be readily transported from one point to another to handle logs necessary to be split at different locations.

Another object of the invention is to provide a log splitting device which does not require, associated therewith, the use of a swinging sledge hammer or sharp edged axe.

Another object of the invention is to provide an improved log splitting device having a central elongate core, optimally cylindrical, having a wedge fixed to the bottom end thereof, there being provided an elongate sleeve with paired handles thereon adapted to slidingly enclose the central core or shaft and reciprocate thereon to deliver impacts on the shaft and therethrough, along the axis thereof, to the wedge and thus to the log or wood piece to be split.

Another object of the invention is to provide such a log splitting device which is relatively cheap and easy to manufacture, having a minimal number of parts, per se and a minimum number of moving parts, none of the parts of the device requiring great precision or upkeep and maintenance and which is not readily subject to deterioration if left exposed to the weather as compared to known and conventional log splitting devices.

Another object of the invention is to provide a log splitting device wherein, once the wedge is placed on the end of the log to be split in the fashion desired, the operator may stand at any position around the log with respect to the wedge. That is, the user or operator is not restricted to merely one side or the other of the splitting device once the wedge is placed into position.

Another object of the invention is to provide a log splitting device as described wherein the subject log splitter involves a telescoping of parts yet wherein the handles for the separate parts are so spaced that the operator will not pinch or injure his hand in hnadling or carrying the two members, alone or together, or in refitting them together or taking them apart.

Yet another object of the invention is to provide a log splitting device as described wherein an elongate shaft having a wedge thereon is driven or forced by successive impacts into and perhaps through all or a good portion of a log being split. The handle provided for such central shaft portion is able or adapted to go wholly or partly into the log split also without impeding the splitting operation materially.

Other and further objects of the invention will appear in the course of the following description thereof.

THE DRAWINGS

In the drawings, which form a part of the instant specification and are to be read in conjunction therewith, embodiments of the invention are shown and, the various views, like numerals are employed to indicate like parts.

STRUCTURE AND FUNCTION

Figure 5:
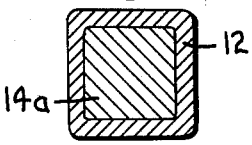
FIG. 5 is a view taken along the line 5—5 of FIG. 1 in the direction of the arrows.

Referring to the drawings, inner elongate shaft 10 is preferably cylindrical in form (circular in transverse, normal cross-section) and has upper end 11 and lower end 12. As may be seen in FIG. 6, upper end 11 preferably has a cylindrical steel plug 13 welded or otherwise fixedly attached therein for impact receiving purposes to be described. The lower end 12 is formed or shaped (as seen in FIG. 5) to square or rectangular transverse normal section and receives fixedly therein the upper end 14*a* of wedge 14. Wedge 14, as may be seen in the lower parts of FIGS. 1 and 2, typically has broader faces 14*b* opposed to one another of rectangular shape with triangular narrow faces 14*c* at the sides thereof. The lower end of the wedge conventionally and preferably ends in a sharpened lower tip 14*d*. Other tools, as will be noted below, may be fixed at the lower end of shaft 10.

Figure 1:
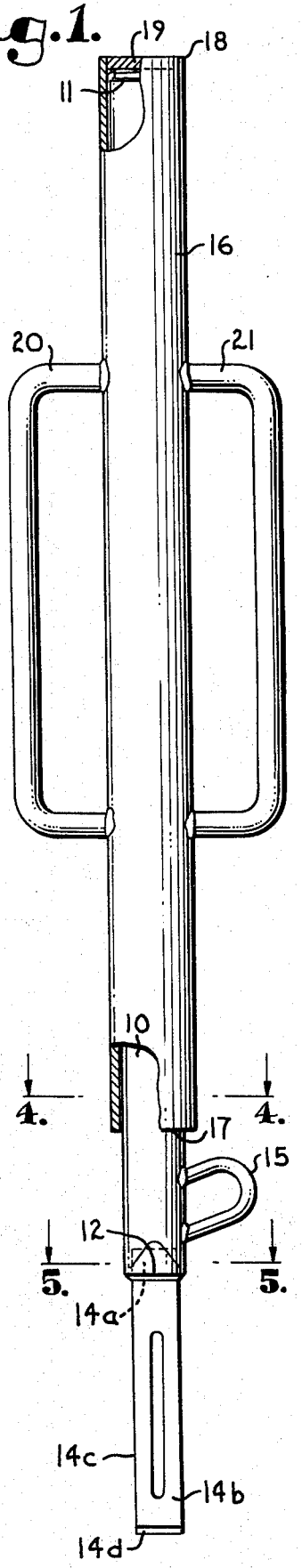
FIG. 1 is a front view of the device in telescoped (nonexpanded) position, the device oriented in vertical operating position with parts thereof cut away to better illustrate details of construction.
Figure 2:
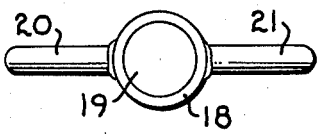
FIG. 2 is a top plan view of the device in FIG. 1.
Figure 3:
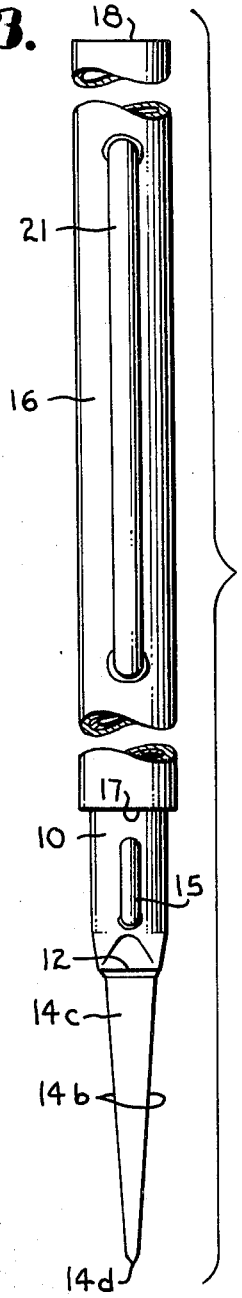
FIG. 3 is a condensed side view (broken in two places) of the device of FIGS. 1 and 2, primarily showing the paired grasping handles on the outer sleeve, the single carrying handle on the inner member and the side elevation of the wedge. This view is taken from the right side of FIG. 1 looking to the left in that view.
Figure 4:
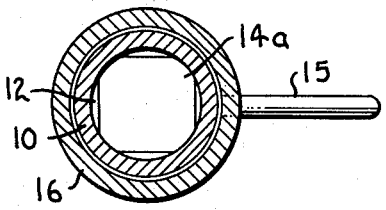
FIG. 4 is a view taken along the line 4—4 of FIG. 1 in the direction of the arrows.

Fixed to the lower end of shaft 10 above the wedge connection at 12 is a handle 15 which is preferably a closed steel loop of structure as seen in FIGS. 1 and 3, welded or otherwise fixedly attached to the outside of cylinder-shaft 10. The position of this handle with respect to the configuration of the wedge is quite important. That is, handle 16 should be parallel to faces 14*b* (the broad rectangular sides) of wedge 14 and normal to the triangular faces 14*c* thereof. The loop handle 16 is preferably inclined as seen in FIG. 1 from true normal to the surface of shaft 10 for purposes to be described. The broad sides 14*b* of the wedge may be rectangular as seen, frusto-conical upwardly (widened downwardly) or frusto-conical downwardly (narrowed downwardly).

A typical (but not limiting) length of shaft 10 (exclusive of wedge 14) is 36 inches. Plug 13 may extend one-quarter to three-quarters inches above the upper end 11 of the shaft. Shaft 10 may typically be 2⅜ inch diameter steel pipe of ¼ to ½ inch thickness. Plug 13 may be several inches deep. The length of the wedge may vary as desired but, in the device shown is approximately eight inches with respect to the length described.

Thus shaft 10 is an elongate, straight shaft of substantially uniform, transverse, normal cross-sectional size and shape along the length thereof with an upper and a lower end. The shaft, in normal working position, is substantially vertical and has an elongate, straight, vertical, longitudinal axis. A penetrating tool is attached to the lower end of the shaft as an extension of the vertical longitudinal axis thereof.

The outer sleeve which slidingly encloses and fits over substantially the entire upper length of shaft 10 is designated 16, with open lower end 17 and upper end 18 closed by plate, stop or impact plug 19. Sleeve 16 is an elongate, hollow sleeve of internal shape like that of the transverse, cross-sectional shape of shaft 10 and slightly lesser length than same. It closely fits over the upper end and substantial length of shaft 10 and slidably moves thereon in work use.

Figure 6:
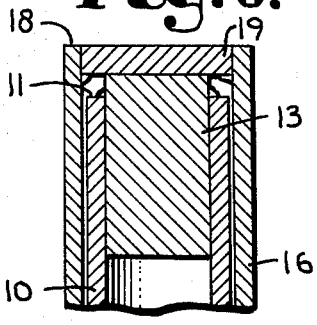
FIG. 6 is an enlarged, sectional view of the upper end of the device of the previous figures, particularly the upper end of FIG. 1, showing the impact block fixed into the top end of the inner member at the top thereof and projecting thereabove.

A pair of handles, preferably closed loops as shown, 20 and 21 are fixed to the outer surface of outer sleeve 16 intermediate ends 17 and 18 thereof, preferably substantially equally spaced from the ends thereof. Handles 20 and 21 are closed loops for strength and protection to the fingers of the user and are of considerable length with respect to the length of outer sleeve 16 to adjust for different heights of different users, as well as comfortable working adjustments for any individual. Plate 19 impacts on the upper surface of plug 13 as seen in FIG. 6 and must be strongly welded or attached within the top end 18 of the outer sleeve 16. Another reason for the length of grips 20 and 21 is the downward movement of wedge or tool 14 and shaft 10 as the wedge is driven into a log or other work.

It is most important that the lower end 17 of sleeve 16 end well short of the upper arm of handle 15 so that there will be no finger pinching or knuckle barking on ends 17 by fingers of the user when the device is carried closed, by the user gripping one handle 20 or 21 with one hand and handle 16 with the other hand.

With respect to the dimensions previously given referring to a typical inner shaft, an optimum length of outer sleeve 16 would be thirty two inches. The handles 20 and 21 may be fourteen inches long and spaced nine inches from each end of sleeve 16. Handles 20 and 21 may be of three-quarter inch diameter. The inner diameter of sleeve 16 may be 2½ inches, roughly, giving an eighth of an inch sloppy fit for sliding purposes on the inner shaft or sleeve 10. Cap 19 may be three-eights of an inch to one inch thick, sufficient to handle an innumerable number of heavy impacts on the upper end of plug 13 without change of shape. Sleeve 16 may be one-quarter or three-eighths inch steel in thickness. It must be kept in mind that a balance must be achieved between acceptable carrying weight for the assembly and working mass to make an effective wood splitting or material penetrating device. The entire device may typically weigh, assembled, 35 to 50 or more pounds.

In use, the device is transported to the wood to be split (or the material to be penetrated) typically in an assembled position with the user grasping the lower handle 15 on the inner shaft with one hand and one of the handles 20, 21 with the other hand. In splitting logs, one typically assumes a log height of sixteen to twenty inches. This gives a height of the top of the device, closed down on top of a log before splitting, of some sixty to sixty four inches. The top of the handles 20, 21 would be some nine inches below this, giving convenient gripping height for men from 5 to 7 or 5½ to 6½ feet in height. The clearance of grips 20 and 21 may be about, more usually two inches from the sleeve wall.

In use, with the log or work set on end to be split or penetrated, the operator grasps the device and raises it vertically, placing the cutting end of the wedge in desired position on the work. The operator then grasps the handles and rotates the outer sleeve around the inner shaft to the position from which he wishes to work. Thus, there are two positions to determine, first, the position of the wedge on the work and, secondly, the position of the outer sleeve with respect to inner shaft and wedge. A cylindrical shape (circular cross section) on the shaft and sleeve permit rotation of the sleeve on the shaft to a desired position as noted.

The operator then reciprocates vertically the sleeve on the inner shaft so the cap on the outer sleeve impacts on plug 13, repeatedly, transmitting longitudinal thrusts along the longitudinal axis of the inner shaft 10 into the material and thus into the work or log. In the splitting of the log, the wedge drives down into the log with its increasing width as seen in FIG. 3. Lower end 12 of inner shaft 10 is (importantly) beveled on both sides, that is, on the wide flat sides and their triangular upwardly increasing sides. Thus, the lower end of the inner shaft may also penetrate into the work. Yet further, because of the splitting action, the handle 15 may pass down into the work or log in the course of splitting to get full extension of inner shaft 10 into the work for full splitting purposes. Thus it can be seen that the direction of the cutting tip of the wedge, the length of the wedge, the bevel of the lower end of inner shaft 10 the alignment of handle 15 with the tapered face of the wedge (handle 15 normal to one face **14*c***) and the total length of the tool that may be forced into a log or the like are all significant.

It thus can be seen that, preferably, at least a foot length of wedge, lower shaft, etc. can pass into the log for splitting purposes before there would be impact of outer sleeve 16 on the log. The increasing wedging width splits the log before the outer sleeve contacts the top of the log.

In the event that the device is used for asphalt penetration, concrete splitting or the like, the sixteen to twenty inches normally allowed for a log in a log splitting operation may be added to the upper end of the inner shaft, to provide a greater length, in order the operator may have sufficient available length to drive the tool into the work, asphalt, concrete, etc.

Said otherwise, to position the sleeve 16 properly in height with respect to a user, when the tool tip starts on the work at the user's foot level, the inner shaft 10 may be increased in length one and one half to two feet if desired. Sleeve 16 may be decreased or increased in length as desired, depending on the total weight required or desired.

The tool at the lower end may be changed in configuration to a rounded, conical tip tool or any desired shape, depending upon the nature of the work.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A tool of the character described, comprising, in combination:

(1) an elongate, straight shaft of substantially uniform transverse, cross-sectional size and shape along the length thereof having an upper and a lower end, (2) said shaft, in normal working position, extending substantially vertically and having an elongate, straight, vertical longitudinal axis, (3) penetrating tool means attached to the lower end of said shaft in an extension of the vertical longitudinal axis thereof, (4) said penetrating tool comprising a wedge having two broad faces and two narrow faces opposed to themselves on opposite sides thereof, (5) the lower end of the said shaft beveled on opposite sides thereof in line with the two broad faces of the wedge and in substantial extension and continuation thereof, (6) an elongate, hollow sleeve of internal shape like that of the transverse cross-sectional shape of the shaft and somewhat less length than said shaft closely fitting over the upper end and substantial length of said shaft and slidably movable thereon, (7) the upper end of said sleeve closed and adapted to impact on the outer end of said shaft and transmit longitudinal thrust thereinto along the said vertical longitudinal axis thereof into said tool, (8) the shaft and sleeve being of circular transverse cross-sectional form, (9) a pair of opposed grasping handles on the outside of said sleeve fixed thereto intermediate the ends thereof, said handles being of closed loop form and substantially 180° opposed to one another, and

(10) a handle on the lowermost portion of said shaft below the lower extremity of the sleeve when the top of the latter rests on the top of the shaft, the handle on the shaft being of closed loop form and positioned normal to the broader faces of the wedge.

2. A device as in claim 1 wherein the closed loop handle on the shaft is inclined slightly upwardly outwardly thereof.

3. A device as in claim 1 wherein the shaft is itself an elongate hollow sleeve and the top of said shaft has an elongate, solid plug fixed in the top thereof adapted to receive the impact thereon of the top of the outer sleeve.

* * * * *